US006712536B2

(12) United States Patent
Miyano

(10) Patent No.: US 6,712,536 B2
(45) Date of Patent: Mar. 30, 2004

(54) PRINTER

(75) Inventor: Tsuyoshi Miyano, Sunnyvale, CA (US)

(73) Assignee: ALPS Electric Co., Ltd., Tokyo (JP)

( * ) Notice: Subject to any disclaimer, the term of this patent is extended or adjusted under 35 U.S.C. 154(b) by 0 days.

(21) Appl. No.: 09/973,980

(22) Filed: Oct. 9, 2001

(65) Prior Publication Data

US 2003/0068184 A1 Apr. 10, 2003

(51) Int. Cl.[7] ..... B41J 11/46; B41J 2/385

(52) U.S. Cl. ..... 400/582; 347/116

(58) Field of Search ..... 400/582, 578, 400/279; 347/13, 116, 81, 177; 358/1.12, 514; 235/435, 439; 271/3.15, 261, 265.03

(56) References Cited

U.S. PATENT DOCUMENTS 4,829,326 A * 5/1989 Emmett et al. ..... 347/116
5,127,752 A * 7/1992 Courtney ..... 400/342
5,160,946 A * 11/1992 Hwang ..... 347/116
5,266,976 A * 11/1993 Ohigashi et al. ..... 347/116
5,572,291 A * 11/1996 Moriguchi et al. ..... 399/390
5,748,221 A * 5/1998 Castelli et al. ..... 347/232
5,909,235 A * 6/1999 Folkins ..... 347/240
6,222,575 B1 * 4/2001 Liu et al. ..... 347/217
6,340,984 B1 * 1/2002 Ui et al. ..... 347/139
6,375,296 B1 * 4/2002 McGarry et al. ..... 347/13
2001/0046401 A1 * 11/2001 Lien et al. ..... 400/240

* cited by examiner

*Primary Examiner*—Ren Yan
*Assistant Examiner*—Hoai-An D. Nguyen
(74) *Attorney, Agent, or Firm*—Beyer Weaver & Thomas

(57) ABSTRACT

A printer prints images on a printing medium having a mark. The printer includes an optical sensor, a feeding section, a controller, and a printing section. The optical sensor is operable to generate a signal based on a position of the mark of the printing medium with respect to the optical sensor. The feeding section is operable to perform feeding of the printing medium. The controller is operable to control the feeding of the printing medium based on the signal. The printing section is operable to print images on the printing medium.

10 Claims, 3 Drawing Sheets

PRINTER

BACKGROUND OF THE INVENTION

The present invention relates to printers, and more specifically, to apparatus and methods for printing on a card with high precision.

Thermal printers are used for printing various documents including personal identification cards. Typically, these identification cards have images on their surfaces printed in various colors. Some cards have images printed in metallic color. Further, some cards have a lenticular lens thereon so that a user can see different images depending on the viewing angle with respect to the normal direction of the surface of the card.

In the prior art, when an image sheet having printed images thereon is affixed onto a plastic sheet having a lenticular lens thereon, alignment of these two sheets requires high precision. Misalignment of the image sheet and the lenticular lens sheet would result in mixed or blurred images of the two separate images. In a normal lenticular card, only one of the two images can be seen if the user fixes the point of view. In order to align the image sheet with the lenticular sheet, the prior art technique requires a skilled worker to manually align the two sheets. This is a time-consuming task, and thus incurs cost. Besides, due to the manual alignment, the yield of the resulting product is low.

In view of these and other issues, it would be desirable to have a technique allowing a printer to print images with high precision.

SUMMARY OF THE INVENTION

According to various embodiments of the present invention, a printer prints images on a printing medium having a mark. The printer includes an optical sensor, a feeding section, a controller, and a printing section. The optical sensor is operable to generate a signal based on a position of the mark of the printing medium with respect to the optical sensor. The feeding section is operable to perform feeding of the printing medium. The controller is operable to control the feeding of the printing medium based on the signal. The printing section is operable to print images on the printing medium.

In a specific embodiment, the sensor is a linear optical sensor which is operable to detect the mark provided on the printing medium. Based on a signal output from the sensor, the controller aligns the printing medium with the images printed on the medium using the feeding section.

In some embodiments, the mark is a line or a stripe drawn on the printing medium diagonally with respect to the line.

In some specific embodiments, the printing section includes an intermediate transfer film, a print head, and an intermediate transfer roller. The print head has a plurality of resistance heating elements for transfer of the ink from the ink film to the intermediate transfer film. The intermediate transfer roller is operable to heat the ink on the intermediate transfer film for transfer of the ink from the intermediate transfer film to the printing medium.

A further understanding of the nature and advantages of the present invention may be realized by reference to the remaining portions of the specification and the drawings.

BRIEF DESCRIPTION OF THE DRAWING

The invention, together with further objects and advantages thereof, may best be understood by reference to the following description taken in conjunction with the accompanying drawings in which.

DETAILED DESCRIPTION OF SPECIFIC EMBODIMENTS

Various embodiments of the present invention will now be described in detail with reference to the drawings, wherein like elements are referred to with like reference labels throughout.

As described in detail below, various embodiments of the present invention include an optical sensor which is operable to generate a signal based on a position of mark provided on a printing medium. Thus, the embodiments of the present invention are capable of aligning the printing medium with high precision, thereby avoiding misalignment of images printed on the medium with respect to the medium.

In this specification, "regular color ink" means any ink other than the metallic ink, which includes, for example, cyan ink, magenta ink, yellow ink, black ink, and white ink. A "regular color ink film" includes any film which carries regular color ink thereon. In this specification, "ink" includes regular color ink and metallic ink which presents metallic color. An "ink film" includes any ink film which carries metallic ink or regular color ink. Thus, the ink film includes regular color ink films 140 and 240, and an intermediate transfer film 148 described in detail below referring to FIGS. 1 and 2.

Figure 1:
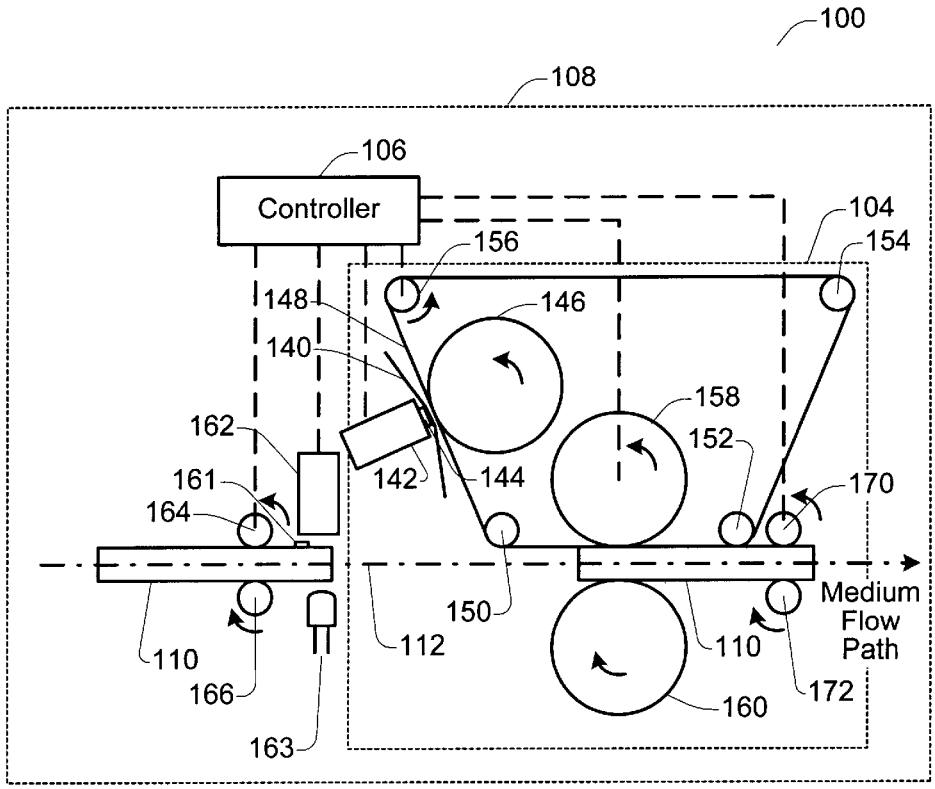
FIG. 1 is a cross-sectional view of a thermal transfer printer of a specific embodiment according to the present invention.

FIG. 1 is a cross-sectional view of a thermal transfer printer 100 of a specific embodiment according to the present invention. The thermal transfer printer 100 includes a thermal transfer printing section 104, and a controller 106 within a housing 108. A printing medium 110 is fed along a medium flow path 112 from left to right in FIG. 1. FIG. 1 shows two locations of the printing medium 110 in the thermal transfer printer 100.

Suitable polymers for the printing medium 110 include polyvinylchloride (PVC), polycarbonate (PC), acrylonitrile-butadiene-styrene (ABS), polypropylene sulfate (PPS), and polyethylene terephthalate glycol (PETG). Circles shown in FIG. 1 represent rollers or platens, and elongated rectangles 110 in FIG. 1 represent cards or plate-like materials used as the printing medium 110.

The thermal transfer printing section 104 is operable to heat regular color ink on the regular color ink film 140 for transfer the regular color ink from the regular color ink film 140 to the printing medium 110. The regular color ink film 140 includes at least one of a cyan color layer, a magenta color layer, a yellow color layer, a black color layer, and a white color layer on a base film. The base film is made from plastic materials including polyethylene terephthalate (PET).

The thermal transfer printing section 104 includes a printing head 142 having a plurality of resistance heating elements 144, and a platen 146. The resistance heating elements 144 apply heat to the regular color ink film 140 based on electric drive pulses representing image data. The printing head 142 presses the regular color ink film 140 and the intermediate transfer film 148 against the platen 146, thereby transferring the regular color ink to the intermediate transfer film 148 by heat and pressure. The intermediate transfer film 148 constitutes a closed loop, which rotates counterclockwise in FIG. 1 supported by feeding rollers 150, 152, 154 and 156.

The regular color ink transferred from the regular color ink film 140 to the intermediate transfer film 148 is carried counter clockwise to a point where an intermediate transfer roller 158 and a platen 160 contact the printing medium 110. In order to determine the exact position of the printing medium 110, the thermal transfer printing section 104 includes a sensor 162 which detects a predetermined point, e.g., a mark 161, provided on the printing medium 110 by utilizing, for example, an optical sensing technique. A light emitting device 163 emits light toward the sensor 162 through the printing medium 110 during detection of the location of the printing medium 110. The light emitting device 163 may be any device which supplies sufficient intensity and wavelength of light for the sensor 162 such as an light emitting diode, a lamp, an electroluminescent lamp, or the like.

In the specific embodiment shown in FIG. 1, the light emitting device 163 is positioned on the opposite side of the sensor 162 with respect to the medium flow path 112 because the sensor 162 generates signal based on the light intensity through the printing medium 110, and the mark 161 on the printing medium 110 varies the transmissivity of the printing medium 110 compared to other part of the printing medium 110. Conversely, when the reflection of the printing medium 110 is varied by the mark 161, the light emitting device 163 is positioned on the same side of the sensor 162 with respect to the medium flow path 112.

Feeding rollers 164 and 166 feed the printing medium 110 onto the intermediate transfer roller 158 and the platen 160 along the medium flow path 112. The controller 106 controls rotational speeds and directions of the feeding roller 164 appropriately.

The printing medium 110 is positioned on a predetermined point on the medium flow path 112 by using the sensor 162 and the feeding roller 164 controlled by the controller 106. Then, the feeding rollers 164 and 166 feed the printing medium 110 onto the intermediate transfer roller 158 and the platen 160 along the medium flow path 112. The intermediate transfer roller 158 presses the intermediate transfer film 148 and the printing medium 110 against the platen 160, thereby transferring the regular color ink from the intermediate transfer film 148 to the printing medium 110 by pressure. Feeding rollers 170 and 172 feed the printing medium 110 out of the housing 108 of the thermal transfer printer 100 along the medium flow path 112. The controller 106 controls rotational speeds and directions of the feeding rollers 170 and 172 appropriately.

Figure 2:
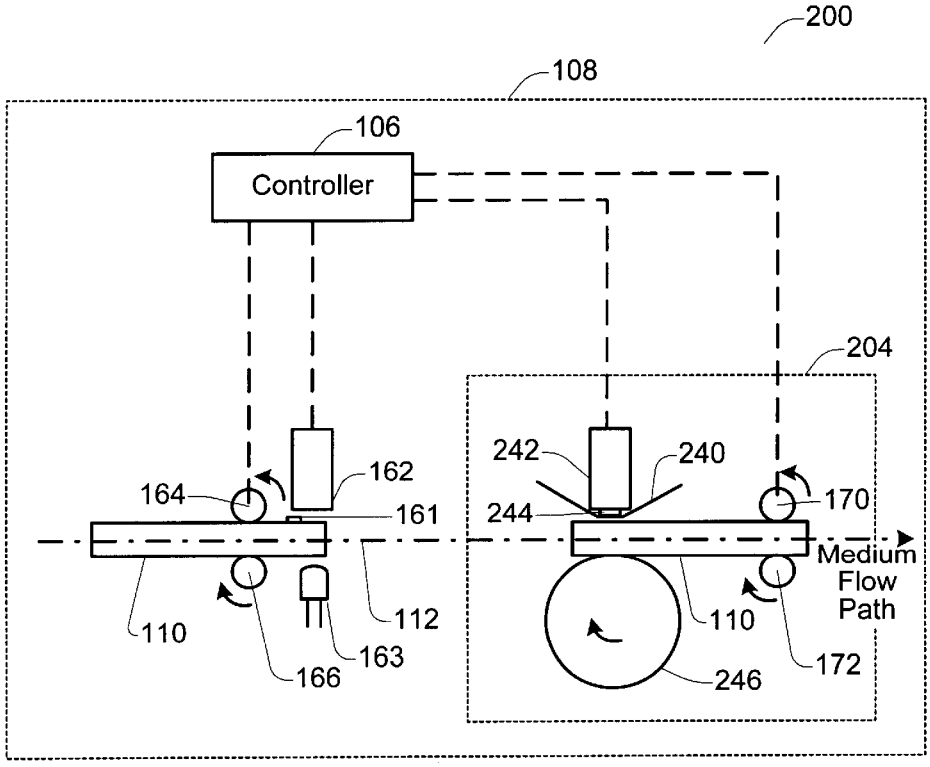
FIG. 2 is a cross-sectional view of a thermal transfer printer of an alternative embodiment according to the present invention.

FIG. 2 is a cross-sectional view of a thermal transfer printer 200 of an alternative embodiment according to the present invention. The thermal transfer printer 200 includes a thermal transfer printing section 204, and the controller 106 within the housing 108. The differences between the embodiments shown in FIGS. 1 and 2 mainly reside in the thermal transfer printing section 204. Thus, it should be appreciated that elements in FIG. 2 which are assigned the same reference labels as shown in FIG. 1 have the same functionalities as those of FIG. 1 with the exception that the elements are designed to be coordinated with the thermal transfer printing section 204.

The thermal transfer printing section 204 is operable to heat regular color ink on the regular color ink film 240 for transfer the regular color ink from the regular color ink film 240 to the printing medium 110. The regular color ink film 240 includes at least one of a cyan color layer, a magenta color layer, a yellow color layer, a black color layer, and a white color layer on a base film, which is made from plastic materials including PET.

The thermal transfer printing section 204 includes a printing head 242 having a plurality of resistance heating elements 244, and a platen 246. The resistance heating elements 244 apply heat to the regular color ink film 240 based on electric drive pulses representing image data. The printing head 242 presses the regular color ink film 240 and the printing medium 110 against the platen 246, thereby transferring the regular color ink from the regular color ink film 240 to the printing medium 110 by heat and pressure.

Figure 3:
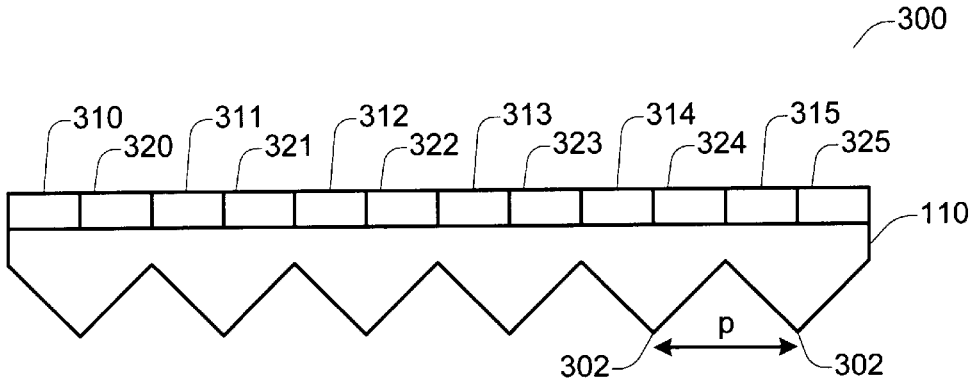
FIG. 3 is a cross-sectional view of a card after the printing process utilizing a specific embodiment of the apparatus and methods according to the present invention.

FIG. 3 is a cross-sectional view of a card 300 after the printing process utilizing a specific embodiment of the apparatus and methods according to the present invention. Before the printing process utilizing the thermal transfer printers 100 and 200, the card 300 includes only the printing medium 110. The printing medium 110 in the card 300 used for a specific embodiment of the present invention includes parallel ridge portions 302 on one side thereof, which may be used as lenticular lenses. In a specific embodiment, the pitch p between the immediately neighboring parallel ridge portions 302 is, for example, 0.254 mm (i.e., 100 line per inch).

After the printing process performed by one of the thermal transfer printing sections 104 and 204, images 310–315 and 320–325 are printed on the printing medium 110. In this specific embodiment, the images 310–315 and 320–325 compose first and second pictures, respectively, where the first and second pictures can be seen from different angles with respect to the normal direction of the card 300. As described in detail below, this specific embodiment of the present invention having the sensor 162 capable of detecting the location of the card 300 with high precision is advantageous especially when the printing medium 110 has the lenticular lenses thereon because aligning the images 310–315 and 320–325 with the ridge portion 302 becomes an issue.

However, it should be appreciated that other images including a plain, single image rather than stripes of images similar to the images 310–315 and 320–325 may be printed on the top surface of the printing medium 110. Furthermore, the printing medium 110 may be any other suitable planar printing medium without including parallel ridge portions 302.

Figure 4:
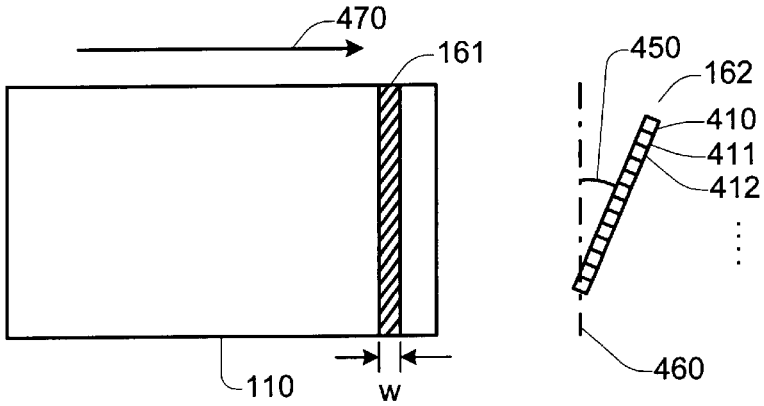
FIG. 4 is a plain view of the printing medium and the sensor used for specific embodiments of the apparatus and methods according to the present invention.

FIG. 4 is a plain view of the printing medium 110 and the sensor 162 used for specific embodiments of the apparatus and methods according to the present invention. As described above referring to FIGS. 1 and 2, the printing medium 110 has the mark 161 thereon. The mark 161 has a different transmissivity rate or a reflection rate compared to other part of the printing medium 110. In a specific embodiment, the mark 161 is provided on the printing medium 110 by printing a black stripe having the width w. However, it should be appreciated that the color and the width w of the mark 161 may be any other suitable color and width. Also, the mark 161 may be provided by any other suitable way such as etching, abrasion, scratching or the like. In the embodiment shown in FIG. 4, the width w ranges from about 0.5 mm to about 1.0 mm. However, in this specification, the term "stripe" covers (i) the mark 161 of which width w is not negligible compared to the size of each of the sensor cells 410, 411, 412, . . . , and (ii) a fine line of which width is substantially negligible compared to the size of each of the sensor cells 410, 411, 412, . . . as described in detail below referring to FIG. 6.

In the specific embodiments shown in FIGS. 1, 2 and 4 of the printer according to the present invention, the sensor 162 is a charge coupled device (CCD) line sensor which has a plurality of sensor cells 410, 411, 412, . . . It should be appreciated that any other suitable linear optical sensor may be used for the sensor 162. In some embodiments, the mark 161 and the longitudinal direction of the sensor 162 intersect at an angle which is substantially non-perpendicular, where a line 460 in FIG. 4 is parallel to the mark 161. In more specific embodiments, the angle 450 at which the mark 161 and the longitudinal direction of the sensor 162 intersect is between about 3 degrees and about 30 degrees. The printing medium 110 is fed along a feeding direction 470 by the feeding rollers 164 and 166. The medium flow path 112 can be a curved line. In such a case, the feeding direction 470 is a direction along which the printing medium 110 is fed in the vicinity of the sensor 162.

Figure 5:
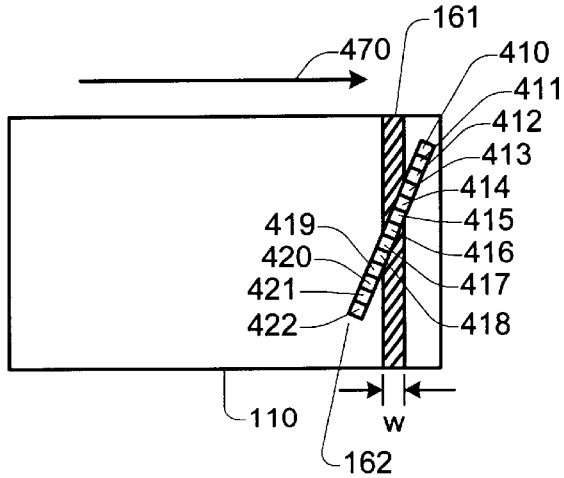
FIG. 5 is a plain view of the printing medium and the sensor used for specific embodiments of the apparatus and methods according to the present invention where the sensor transverses a mark.

FIG. 5 is a plain view of the printing medium 110 and the sensor 162 used for specific embodiments of the apparatus and methods according to the present invention where the sensor 162 transverses the mark 161. During the process of feeding the printing medium 110 toward the thermal transfer printing sections 104 and 204 along the feeding direction 470, the sensor 162 transverses the mark 161. In a specific embodiment shown in FIG. 5, the sensor cells 410–413 and 419–422 output a HIGH level signal corresponding to a high intensity of the incident light, and the sensor cells 414–418 output a LOW level signal corresponding to a low intensity of the incident light. It should be appreciated that the level of the output signal from the sensor 162 may be inverted or shifted depending on the characteristics of the sensor 162 and output circuitry associated with the sensor 162. The controller 106 receives the output signal from the sensor 162 and calculates the distance between the mark 161 on the printing medium 110 and the sensor 162, i.e., the location of the printing medium 110 with respect to the sensor 162, based on the output signal from each of the sensor cells 410–422.

Figure 6:
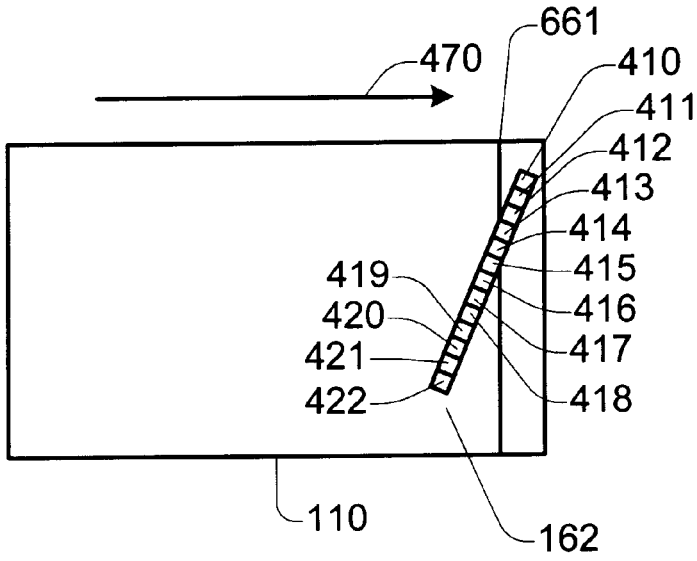
FIG. 6 is a plain view of the printing medium and the sensor used for alternative embodiments of the apparatus and methods according to the present invention where the sensor transverses a mark.

FIG. 6 is a plain view of the printing medium 110 and the sensor 162 used for specific embodiments of the apparatus and methods according to the present invention where the sensor 162 transverses a mark 661. In this specific embodiment, the mark 661 is a fine line of which width is negligible compared to the size of the each of the sensor cells 410–422.

Similar to the operation described referring to FIG. 5, during the process of feeding the printing medium 110 toward the thermal transfer printing sections 104 and 204 along the feeding direction 470, the sensor 162 transverses the mark 661. In a specific embodiment shown in FIG. 6, the sensor cells 410–412 and 415–422 output a HIGH level signal corresponding to a high intensity of the incident light, and the sensor cells 413 and 414 output a LOW level signal corresponding to a low intensity of the incident light. It should be appreciated that the level of the output signal from the sensor 162 may be inverted or shifted depending on the characteristics of the sensor 162 and output circuitry associated with the sensor 162. The controller 106 receives the output signal from the sensor 162 and calculates the distance between the mark 661 on the printing medium 110 and the sensor 162, i.e., the location of the printing medium 110 with respect to the sensor 162, based on the output signal from each of the sensor cells 410–422.

Figure 7:
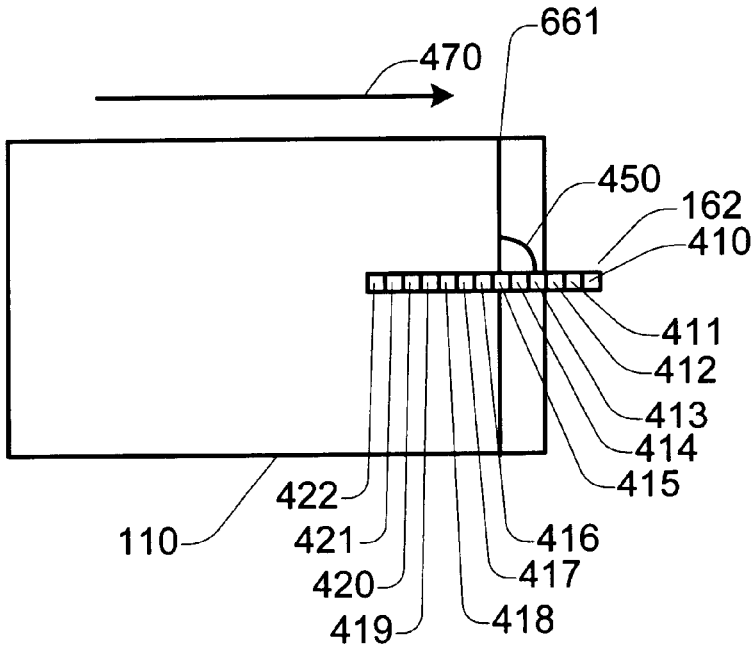
FIG. 7 is a plain view of the printing medium and the sensor in an alternative configuration used for specific embodiments of the apparatus and methods according to the present invention where the sensor transverses a mark.

FIG. 7 is a plain view of the printing medium 110 and the sensor 162 used for specific embodiments of the apparatus and methods according to the present invention where the sensor 162 transverses a mark 661. In this specific embodiment, the mark 661 and the longitudinal direction of the sensor 162 intersect at an angle which is substantially perpendicular. In other words, the angle 450 in FIG. 7 is substantially 90 degrees.

Similar to the operation described referring to FIG. 5, during the process of feeding the printing medium 110 toward the thermal transfer printing sections 104 and 204 along the feeding direction 470, the sensor 162 transverses the mark 661. In a specific embodiment shown in FIG. 7, the sensor cells 410–414 and 416–422 output a HIGH level signal corresponding to a high intensity of the incident light, and the sensor cell 415 outputs a LOW level signal corresponding to a low intensity of the incident light. It should be appreciated that the level of the output signal from the sensor 162 may be inverted or shifted depending on the characteristics of the sensor 162 and output circuitry associated with the sensor 162. The controller 106 receives the output signal from the sensor 162 and calculates the distance between the mark 661 on the printing medium 110 and the sensor 162, i.e., the location of the printing medium 110 with respect to the sensor 162, based on the output signal from each of the sensor cells 410–422.

The embodiments described above referring to FIGS. 4–6 where the sensor 162 is provided so that the angle 450 is substantially non-perpendicular are advantageous especially when higher detection resolution of the sensor 162 is necessary. Suppose that the sensor 162 has a longitudinal length of 25 mm, having 500 sensor cells, and the angle 450 is 11.5 degrees. Then, the detection resolution of the sensor 162 is improved up to 0.01 mm (=25×sin 11.5/500). Here, the detection resolution is defined as a resolution along the feeding direction 470 while actual resolution of the sensor 162 is defined as a resolution along the longitudinal direction of the sensor 162.

It should be appreciated that the angle 450 which is substantially 90 degrees may be applied to the embodiment illustrated in FIGS. 4 and 5. In the specific embodiments described above, the sensor 162 is a CCD line sensor. However, the sensor 162 may be a two-dimensional CCD sensor as long as the sensor 162 traverses the mark on the printing medium 110 during the feeding of the printing medium 110. Alternatively, the sensor 162 may be any suitable sensor which is capable of detecting the location of the printing medium 110.

The specific embodiments of the present invention described referring to FIGS. 1 and 2 utilize the roller printing section 102. However, it should be appreciated that the sensor 162 may be used with only one of the thermal transfer printing sections 104 and 204, i.e., without employing the roller printing section 102. The thermal transfer printing sections 104 and 204 may be replaced by any other suitable printing mechanism such as an ink jet print engine, a bubble jet print engine, an electrophotographic print engine, a dot impact print engine or the like.

The specific embodiment of the apparatus and methods according to the present invention described above referring to FIG. 1 can be implemented by utilizing the thermal transfer printer 200 illustrated in FIG. 2 in a similar manner except that the regular color printing is performed by the thermal transfer printing section 204 rather than the thermal transfer printing section 104. Thus, further detail is omitted.

In the specific embodiments described above, the regular color printing by the thermal transfer printing sections 104 and 204 can be implemented by a single thermal head. However, it should be appreciated that a plurality of thermal heads can be used for the regular color printing.

In the specific embodiments described above, the image layer printing by the thermal transfer printing sections 104 and 204 can be implemented by a single thermal head. However, it should be appreciated that a plurality of thermal heads can be used for the regular color printing. For example, five separate thermal heads can be used for five colors (e.g., cyan, magenta, yellow, and black and white) for the thermal transfer printing sections 104 and 204.

In the above-described specific embodiments of the thermal transfer printer according to the present invention described referring to FIGS. 1 and 2, the feeding rollers 164, 166, 170 and 172 are appropriately positioned along the medium flow path 112 so that the position of the printing medium 110 is controlled to go back and forth along the medium flow path 112 based on a specific printing process which is applied to the printing medium 110.

In the above embodiments of the thermal transfer printer according to the present invention described referring to FIGS. 1 and 2, the controller 106 can be implemented by any combination of software and/or hardware. For example, the controller 106 can be implemented by a microprocessor, a memory device which stores instruction codes and data, and an interface which drives external devices such as the feeding rollers, the transfer roller, and the intermediate transfer roller.

Although only a few embodiments of the present invention have been described in detail, it should be understood that the present invention may be embodied in many other specific forms without departing from the spirit or scope of the invention. For example, although the illustrated embodiments have been described primarily in the context of a thermal transfer printer for printing images on a plastic card, it should be appreciated that various materials may be used for embodiments of the thermal transfer printer according to the present invention. Therefore, it should be apparent that the above described embodiments are to be considered as illustrative and not restrictive, and the invention is not to be limited to the details given herein, but may be modified within the scope of the appended claims.

What is claimed is:

1. A printer for printing on a printing medium having a mark, comprising:

an optical sensor operable to generate a signal based on a position of the mark of the printing medium with respect to the optical sensor;

a feeding section operable to perform feeding of the printing medium;

a controller operable to control the feeding of the printing medium based on the signal; and a printing section operable to print images on the printing medium, wherein the optical sensor is operable to generate the signal by sensing a change of transmissivity of the printing medium;

the optical sensor is a CCD line sensor having a longitudinal direction along which a plurality of sensor cells constituting the CCD line sensor are provided;

the mark is a stripe drawn on the printing medium;

the stripe is substantially a line;

the line is drawn substantially perpendicular to a feeding direction along which the feeding section feeds the printing medium;

the line and the longitudinal direction of the CCD line sensor intersect at an angle which is substantially non-perpendicular; and the line traverses all of the sensor cells while the printing medium is being fed.

2. The printer of claim 1, wherein the line and the longitudinal direction of the CCD line sensor intersect at an angle which is between about 3 degrees and about 30 degrees.

3. The printer of claim 1, wherein the printing section includes:

a thermal transfer printing section operable to heat ink on an ink film for transfer of the ink from the ink film to the printing medium; and a platen against which the thermal transfer printing section presses the ink film and the printing medium.

4. The printer of claim 3, wherein the thermal transfer printing section includes:

an intermediate transfer film, a print head having a plurality of resistance heating elements for transfer of the ink from the ink film to the intermediate transfer film, and an intermediate transfer roller operable to heat the ink on the intermediate transfer film for transfer of the ink from the intermediate transfer film to the printing medium.

5. The printer of claim 3, wherein the thermal transfer printing section includes:

a print head having a plurality of resistance heating elements for transfer of the ink from the ink film to the intermediate transfer film.

6. A printer for printing on a printing medium having a mark, comprising:

means for generating a signal based on a position of the mark of the printing medium with respect to an optical sensor;

means for feeding the printing medium;

means for controlling the feeding of the printing medium based on the signal; and means for printing images on the printing medium;

wherein the optical sensor is operable to generate the signal by sensing a change of transmissivity of the printing medium;

the optical sensor is a CCD line sensor having a longitudinal direction along which a plurality of sensor cells constituting the CCD line sensor are provided;

the mark is a stripe drawn on the printing medium;

the stripe is substantially a line;

the line is drawn substantially perpendicular to a feeding direction along which the feeding section feeds the printing medium;

the line and the longitudinal direction of the CCD line sensor intersect at an angle which is substantially non-perpendicular; and the line traverses all of the sensor cells while the printing medium is being fed.

7. A method of printing on a printing medium having a mark, comprising:

generating by an optical sensor a signal based on a position of the mark of the printing medium with respect to the optical sensor;

feeding the printing medium;

controlling the feeding of the printing medium based on the signal; and printing images on the printing medium;

wherein the optical sensor is operable to generate the signal by sensing a change of transmissivity of the printing medium;

the optical sensor is a CCD line sensor having a longitudinal direction along which a plurality of sensor cells constituting the CCD line sensor are provided;

the mark is a stripe drawn on the printing medium;

the stripe is substantially a line;

the line is drawn substantially perpendicular to a feeding direction along which the feeding section feeds the printing medium;

the line and the longitudinal direction of the CCD line sensor intersect at an angle which is substantially non-perpendicular; and the line traverses all of the sensor cells while the printing medium is being fed.

8. The method of claim 7, wherein the line and the longitudinal direction of the CCD line sensor intersect at an angle which is between about 3 degrees and about 30 degrees.

9. The method of claim 7, wherein the printing includes:

heating ink on an ink film for transfer of the ink from the ink film to the printing medium; and pressing the ink film and the printing medium against a platen.

10. The method of claim 7, wherein the printing includes:

heating ink on an ink film for transfer of the ink from the ink film to an intermediate transfer film, pressing the ink film and the intermediate transfer film against a first platen, pressing the ink on the intermediate transfer film for transfer of the ink from the intermediate transfer film to the printing medium.

* * * * *